United States Patent [19]

Ohashi

[11] Patent Number: 4,858,079

[45] Date of Patent: Aug. 15, 1989

[54] LIGHT PROJECTING TOY MUSICAL BOX

[75] Inventor: Michiya Ohashi, Tokyo, Japan

[73] Assignee: Tomy Kogyo Co., Inc., Tokyo, Japan

[21] Appl. No.: 238,528

[22] Filed: Aug. 31, 1988

[30] Foreign Application Priority Data

Nov. 16, 1987 [JP] Japan ..... 62-174583[U]
Jan. 27, 1988 [JP] Japan ..... 63-9094[U]

[51] Int. Cl.[4] ..... F21V 21/30; A63H 1/28

[52] U.S. Cl. ..... 362/35; 446/242; 446/485; 362/806; 353/62; 434/286; 84/95.2; 40/431

[58] Field of Search ..... 446/241-244, 446/246, 265, 236, 219, 397, 485, 408, 227; 362/361, 35, 806, 809, 811, 363, 86; 40/432, 431; 353/15, 62, 122, 19; 84/94.2, 95.2; 434/286, 287

[56] References Cited

U.S. PATENT DOCUMENTS 2,526,514 10/1950 Stadtmiller ..... 40/432
2,916,850 12/1959 Vlachos ..... 446/265
3,349,661 10/1967 Searls ..... 446/265 X
3,525,862 8/1970 Carter et al. ..... 362/86
4,146,919 3/1979 Jennings ..... 362/35
4,277,912 7/1981 Hsien ..... 446/259 X
4,618,330 10/1986 Abe ..... 446/265 X
4,670,820 6/1987 Eddins et al. ..... 362/86

FOREIGN PATENT DOCUMENTS 520343 3/1931 Fed. Rep. of Germany ..... 40/431

*Primary Examiner*—Mickey Yu
*Attorney, Agent, or Firm*—Staas & Halsey

[57] ABSTRACT

A light projecting toy musical box projects a light pattern which is synchronized with musical sound generated by an acoustic mechanism. The projected light patterns are formed by providing a lamp within a base and rotatably mounting a dome over the lamp and substantially on top of the base. The dome is made out of translucent material which is patterned with a semi-opaque coating so as to form light patterns on the dome itself and project the light patterns on adjacent ceilings and/or walls of a room.

20 Claims, 3 Drawing Sheets

LIGHT PROJECTING TOY MUSICAL BOX

BACKGROUND OF THE INVENTION

1. Field of the Invention

The present invention relates generally to infant toys, and more specifically, to a light projecting toy musical box in which light is projected through a rotating body whose movement is synchronized with the musical sound created by an acoustic mechanism.

2. Description of the Related Art

Musical boxes having acoustic mechanisms therein are generally well known. For infants, toy musical boxes provide a soothing sound, but have heretofore provided no visual sensation.

While it is likewise generally known to construct a toy musical box with a movable member, such as a doll, capable of synchronized movement with the sound of a musical box, no one has heretofore provided a musical box in which sound is synchronized with a lighting device.

SUMMARY OF THE INVENTION

An object of the present invention is to provide a light projecting toy musical box which is relatively simple in construction and inexpensive to manufacture.

Another object of the invention is to provide a light projecting toy musical box which simultaneously provides visual and audio stimulation for infants.

Another object of the present invention is to provide a light projecting toy musical box in which movement of a light pattern is synchronized with sound generated by an acoustic mechanism.

In one embodiment of the invention, a light projecting toy musical box includes a base, a dome movably mounted on the base and being substantially translucent with a pattern formed thereon which is at least partially opaque, a lamp, disposed within the base, which cooperates with the dome to create a light pattern, an acoustic mechanism, disposed within the base, for generating musical sound, and drive means, disposed within the base, for simultaneously moving the dome and actuating the acoustic mechanism so that movement of the dome is synchronized with the musical sound.

Preferably, the lamp is switched on automatically by the drive means. The dome is preferably semi-spherically shaped with an annular flange at a base thereof which is rotatably mounted in an annular groove provided on a top portion of the base.

These objects, together with other objects and advantages which will be subsequently apparent reside in the details of construction and operation of the light emitting toy musical box as more fully hereinafter described and claimed, reference being had to the accompanying drawings forming a part hereof, wherein like reference numerals refer to like parts throughout.

DETAILED DESCRIPTION OF THE PREFERRED EMBODIMENTS

Figure 1:
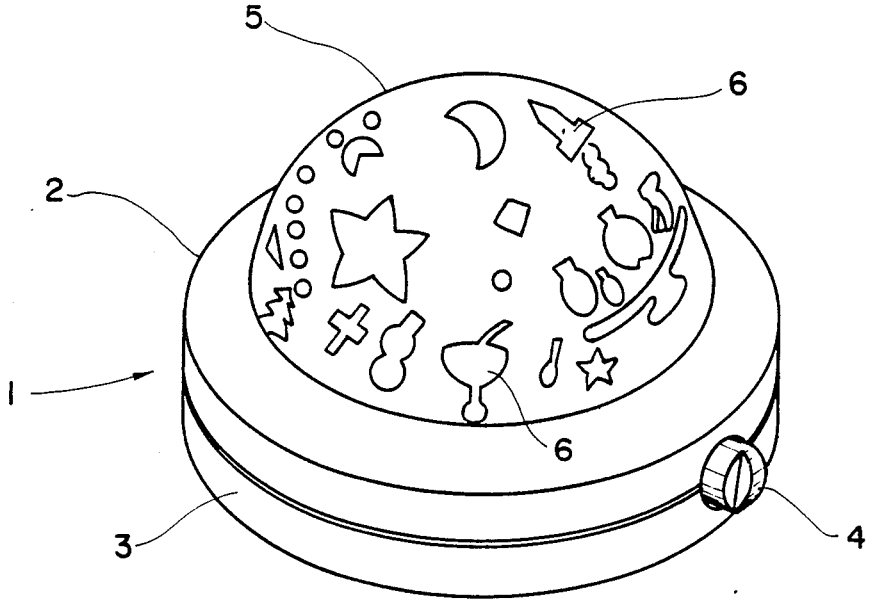
FIG. 1 is a perspective view of a preferred embodiment of the light projecting toy musical box according to the present invention.
Figure 2:
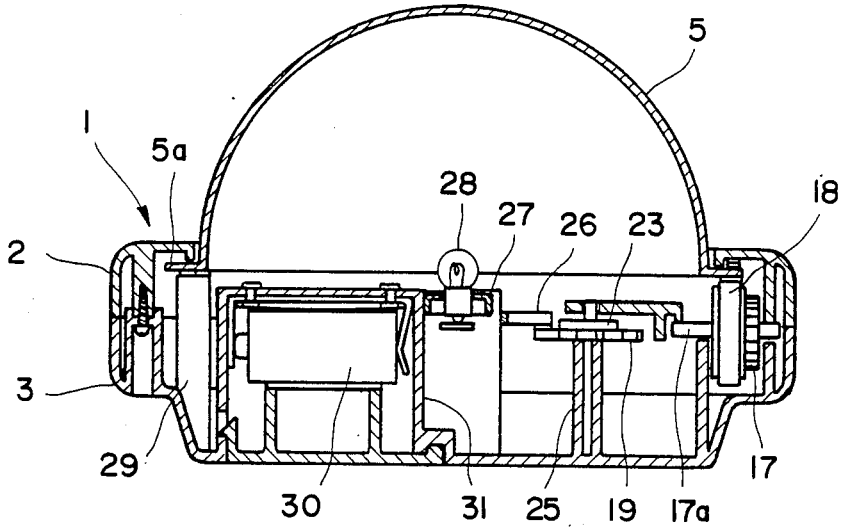
FIG. 2 is a cross-sectional view of the light projecting toy musical box of FIG. 1.

Referring to FIGS. 1 and 2, a base 1 is generally circular in shape and is made of an upper shell member 2 and a lower shell member 3 which are joined together by any suitable means, such as threaded fasteners. A dome 5 is generally semispherically shaped and is rotatably mounted on top of the base 1 by means of an annular flange **5*a* formed at the base of the dome 5. The annular flange 5*a* extends radially outwardly and is received in an annular groove or space provided in an upper portion of the base 1. The annular groove or space may be formed by an inner peripheral surface of the upper shell 2 member and the distal end surfaces of ribs 29 upstanding from an inner surface of the lower shell member 3, or some other structure associated with the lower shell. The flange 5*a* fits loosely in the groove and rests on top of the supporting structure associated with the lower shell member 3, such as the ribs 29**.

The dome 5 has a pattern formed thereon which is at least partially opaque. For example, the translucent dome 5 may be coated on an inner surface thereof with a slightly opaque or semi-transparent milky paint **5*b*. At suitable locations of the coating 5*b*, transparent areas or patterns 6 are formed. Various colored paints which are translucent may be applied to the transparent patterns 6. In addition, patterns 5*c* may be painted on the coating 5*b*. These painted patterns 5*c* will appear on the surface of the dome 5 only when the lamp under the dome is lighted. In another example of forming a pattern on the dome 5**, the translucent dome is painted with semi-transparent paint in a geometric pattern, such as alternating squares, wherein every other square is painted.

Regardless of the desired pattern formed on the dome, the effect is to create a light pattern on the dome which may be projected onto adjacent walls or the ceiling of a room. The toy may also serve as a room lamp since the lamp within the base causes the dome to brightly shine. A light pattern may be formed on the dome 5 and simultaneously projected onto adjacent walls.

Figure 3:
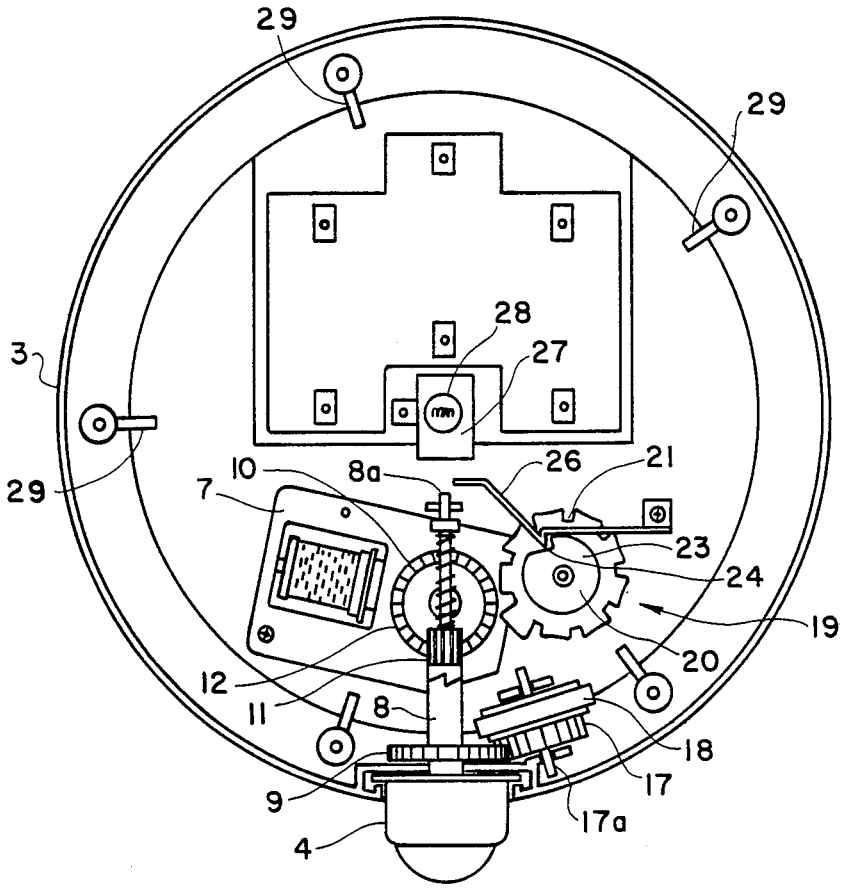
FIG. 3 is a top view showing the drive mechanism used in the embodiment of FIG. 1, with the dome and a portion of the base removed.

Referring to FIG. 3, the lower shell member 3 of the base 1 supports an acoustic mechanism 7, i.e., a musical box, which is driven by a power spring driving mechanism. A power spring 16 is wound on the lower portion of a power spring winding shaft 15, which serves as a power output shaft for delivering torque to the acoustic mechanism 7. A rotation plate 13 is provided on the power spring winding shaft 15 and forms part of a Geneva stop mechanism (to be described later). A crown gear 12 is provided on an upper portion of the shaft 15 above the rotation plate 13.

A knob 4 is provided on a circumferential surface of the base 1 and is used for winding the power spring 16. The knob 4 is connected to and rotatable with a rotatable shaft **8*a* which has opposite ends. One opposite end extends through a sidewall of the base 1 and receives the knob 4. A cylindrical member 8 is integrally formed with a gear 9 and is connected to the rotatable shaft 8*a* so as to rotate therewith. A pinion gear 11 is rotatably mounted on the shaft 8*a* and is spring biased into contact with the cylindrical member 8 by means of a push spring wound around the shaft 8***a*. The contact surface between the cylindrical member 8 and the pinion 11 includes engaging teeth which act as a uni-directional clutch so that the power spring 16 can be wound by turning the knob 4 in one direction, but cannot be unwound by turning the knob 4 in the opposite direction. The pinion gear 11 meshes with the crown gear 12 so that rotation of the pinion gear 11, imparted by rotation of the knob 4, is delivered to the power spring 16 through the crown gear 12.

Figure 4:
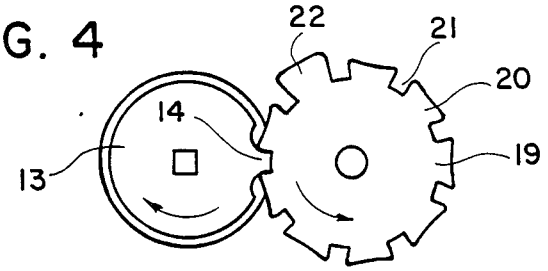
FIG. 4 is a top view showing a power spring stop mechanism used in the embodiment of FIG. 1.
Figure 5:
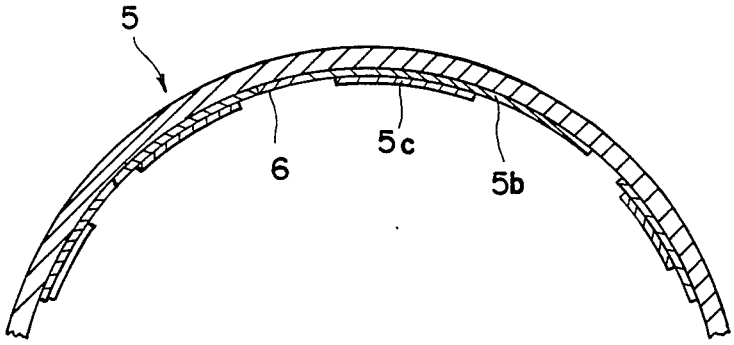
FIG. 5 is a partial, sectional view showing an enlarged portion of the dome.

Referring to FIG. 4, a projection 14 is formed on an outer peripheral surface of the rotatable plate 13. A wheel 19 having alternating cut-away portions 21 and projections 20 is rotatably supported on a bearing member 25 upstanding from the bottom of the lower shell 3. Basically, the rotatable plate 13 and the wheel 19 constitute the Geneva stop mechanism, in which the projection 14 formed on the rotatable plate 13 is receivable between two adjacent projections 20 of the wheel 19. Each time the rotatable plate 13 is rotated once, the projection 14 is fitted into a cut-away portion 21 so that the wheel 19 is intermittently rotated. The wheel 19 further includes a projection 22 which is longer than the remaining projections 20. When the rotatable plate 13 rotates a given number of times, the projection 22 will engage the outer peripheral surface of the rotatable plate 13 so as to act as a stopper for stopping rotation of the rotatable plate 13.

Referring to FIG. 3, a cam plate 23 is fitted on the shaft which supports the wheel 19. A cut-away portion 24 of the cam plate 23 provides a cam surface which moves a conductive contact member 26 into electrical contact when the cam plate 23 is rotated. The contact member 26 is connected to the bottom of the outer shell 3. A bent portion formed in the middle of the contact member 26 is movable into and out of the cut-away portion 24 of the cam plate 23. The distal end portion of the contact member 26 is movable into electrical contact with an electrical contact member 27 which is in contact with one of the terminals of lamp 28. The longer projection 22 of the wheel 19 engages the outer peripheral surface of the rotatable plate 13, thereby stopping the rotation of the rotatable plate 13. When the acoustic mechanism 7 is stopped, the cut-away portion 24 of the cam plate 23 receives the bent portion of the conductive contact member 26, at which point the distal end portion of the conductive contact member 26 is spaced from the conductive contact piece 27. Thus, the lamp 28 is turned off at or about the same time the music stops. When the power spring 16 is wound by turning the knob 4, the wheel 19 and the cam plate 23 are rotated and the bent portion of the conductive contact member 26 is disengaged from the cut-away portion 24 of the cam plate 23 and engages the outer peripheral surface of the cam plate 23. Thus, the conductive contact member 26 flexes outwardly until the tip comes into contact with the conductive contact member 27 and the lamp 28 is thereby turned on.

The gear 9 formed on the cylindrical member 8 meshes with a gear 17 which is fitted on and rotatable with a support shaft 17*a*. A friction wheel 18 has an outer peripheral surface which is made of an elastomeric or rubber material and is fitted on the same shaft 17*a* as the gear 17. The rubber material is preferable because of its high frictional coefficient. Similar materials may be used.

Figure 6:
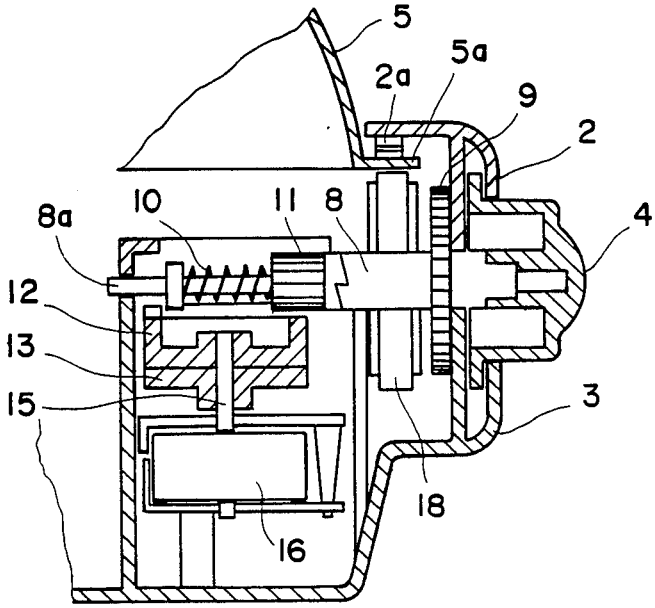
FIG. 6 is an enlarged cross-sectional view showing the drive mechanism used in the embodiment of FIG. 1.

Referring to FIG. 6, the friction wheel 18 is positioned to have the outer friction surface be in contact with a lower surface of he flange 5*a* of the dome 5. A plate spring 2*a* may be mounted on the upper shell member 2 so as to urge the upper surface of the flange 5*a* downwardly to press the flange against the friction wheel 18 to ensure traction. Accordingly, the dome 5 is rotated while the acoustic mechanism is operating under the driving force imparted by the spring 16. Thus, the means for actuating the acoustic mechanism, which includes elements 4, 8, 8*a*, 10, 11, 12, 13, 15 and 16, also drives the dome for rotational movement. The movement of the dome is coordinated or synchronized with musical sound generated by the acoustic mechanism.

The painted patterns 5*c* appear on the surface of the dome, while the transparent pattern 6 are projected onto a ceiling or wall by means of light which passes through the patterns 6.

The lamp 28 is preferably powered by a battery cell 30 or a plurality of such battery cells.

The electrical contact members 26 and 27 provide a switch for the lamp 28 which is actuated automatically by winding the spring 16 with the knob 4, since the rotatable plate 13 rotates the wheel 23 when the spring 16 is wound.

Modifications of the switch include one in which the rotation plate and the crown gear are integrally formed as one member with a projection similar to projection formed thereon. In this embodiment, the wheel and the cam plate are integrally formed such that a cam surface is formed on a lower portion of the wheel. With the projection extending into the cut-away portions as in the previously described embodiment, a flat contact member is disposed between and beneath the crown gear and wheel such that rotation of the wheel cams the flat contact downwardly into electrical contact with a corresponding contact associated with the lamp. The principle of this alternative switch is the same as the one previously described, in that rotation of the wheel 19 (or cam plate 23) imparts movement of an electrical contact into a switched-on position so that the lamp 28 is illuminated during rotation of the dome 5 and during actuation of the acoustic mechanism. Thus, the acoustic mechanism produces musical sound simultaneously with illumination of the lamp and rotation of the dome.

The many features and advantages of the present invention are apparent from the detailed specification, and thus, it is intended by the appended claims to cover all such features and advantages of the light projecting toy musical box which fall within the true spirit and scope of the invention. Further, since numerous modifications and changes will readily occur to those skilled in the art based upon the disclosure herein, it is not desired to limit the invention to the exact construction and operation illustrated and described. Accordingly, all suitable modifications and equivalents may be resorted to falling within the scope and the spirit of the invention.

What is claimed is:

1. A light projecting toy musical box comprising:

a base;

a dome movably mounted on the base and being substantially translucent;

a lamp disposed within the base and projecting light through the dome;

an acoustic mechanism, disposed within the base, for generating musical sound; and drive means, disposed within the base, for simultaneously moving the dome, actuating the acoustic mechanism, and switching on the lamp so that movement of the dome and lighting of the lamp are synchronized with the musical sound generated by the acoustic mechanism.

2. A light projecting toy musical box according to claim 1, further comprising switch means, in electrical contact with the lamp, for automatically turning on and off the lamp in response to activation and deactivation of the drive means.

3. A light projecting toy musical box according to claim 1, wherein the base is substantially circular in shape and is made of an upper shell member and a lower shell member.

4. A light projecting toy musical box according to claim 1, further comprising a battery power source for illuminating the lamp.

5. A light projecting toy musical box according to claim 1, wherein the dome is coated in a pattern, wherein the coating is at least partially opaque such that light projected through the dome creates a light pattern.

6. A light projecting toy musical box according to claim 3, wherein the dome is coated in a pattern, wherein the coating is at least partially opaque such that light projected through the dome creates a light pattern.

7. A light projecting toy musical box according to claim 6, wherein the dome includes a base portion and a flange which extends radially outwardly from the base portion, and the upper and lower shell members define an annular groove for receiving the flange and mounting the dome for rotational movement on the base.

8. A light projecting toy musical box according to claim 1, wherein the drive means includes a spring having a rotatable output shaft which is operatively connected to the acoustic mechanism and to the dome, for actuating the acoustic mechanism and driving the dome in rotational movement.

9. A light projecting toy musical box according to claim 8, wherein the drive means further includes a winding mechanism for winding the spring.

10. A light projecting toy musical box according to claim 9, wherein the winding mechanism includes a rotatable winding shaft having opposite ends, a knob connected to one of the opposite ends which extends outwardly through the base and a clutch which permits rotation of the winding shaft in one direction and prohibits rotation of the winding shaft in an opposite direction.

11. A light projecting toy musical box according to claim 10, wherein the drive means includes a stop mechanism which stops movement of the dome and actuation of the acoustic mechanism at a predetermined point.

12. A light projecting toy musical box according to claim 11, further comprising switch means for turning on and off the lamp, the switch means being movable into an off position when the stop mechanism reaches the predetermined position.

13. A light projecting toy musical box according to claim 12, wherein the drive mechanism includes a rotatable plate having a projection formed thereon, and the stop mechanism includes a rotatable wheel having cut-away portions between a plurality of projections, the projection of the rotatable plate being receivable in any one of the cut-away portions of the rotatable wheel to deactivate the drive means.

14. A light projecting toy musical box according to claim 1, wherein the drive means comprises a spring having a rotatable output shaft operatively connected to the acoustic mechanism, a winding shaft having opposite ends, one of the opposite ends extending outwardly through the base, a knob connected to the outwardly extending end of the winding shaft, a first gear operatively connected to the winding shaft through a clutch mechanism which allows the first gear to rotate in a winding direction and prohibits rotation in a direction opposite the winding direction, a second gear connected to the output shaft of the spring and meshing with the first gear, a third gear connected to the winding shaft, and a friction wheel rotatably mounted in the base and having a peripheral friction surface which engages the dome to impart rotation thereof and a fourth gear connected to the friction wheel and meshing with the third gear so as to complete a power path from the spring to the friction wheel.

15. A light projecting toy musical box according to claim 8, wherein the drive means includes a friction wheel operatively connected to the output shaft of the spring and being positioned in the base to rotate in contact with the spring.

16. A light projecting toy musical box comprising:

a base;

a dome movably mounted on the base and being substantially translucent;

a lamp disposed within the base and projecting light through the dome;

an acoustic mechanism, disposed within the base, for generating musical sound; and drive means, disposed within the base, for simultaneously moving the dome, actuating the acoustic mechanism, and switching on the lamp so that movement of the dome and lighting of the lamp are synchronized with the musical sound generated by the acoustic mechanism;

wherein the drive means includes a spring having a rotatable output shaft and being operatively connected to the acoustic mechanism and the dome for actuating the acoustic mechanism and driving the dome in rotational movement.

17. A light projecting toy musical box according to claim 16, wherein the drive means further includes a winding mechanism for winding the spring, and a stop mechanism which stops movement of the dome and actuation of the acoustic mechanism at a predetermined point.

18. A light projecting toy musical box according to claim 17, wherein the winding mechanism includes a rotatable winding shaft having opposite ends, a knob connected to one of the opposite ends which extends outwardly through the base and a clutch which permits rotation of the winding shaft in one direction and prohibits rotation of the winding shaft in an opposite direction.

19. A light projecting toy musical box according to claim 18, further comprising switch means for turning on and off the lamp, the switch means being movable into an off position when the stop mechanism reaches the predetermined position.

20. A light projecting toy musical box according to claim 19, wherein the drive mechanism includes a rotatable plate having a projection formed thereon, and the stop mechanism includes a rotatable wheel having cut-away portions between a plurality of projections, the projection of the rotatable plate being receivable in any one of the cut-away portions of the rotatable wheel to deactivate the drive means.

* * * * *